United States Patent [19]

Rynearson

[11] Patent Number: 4,566,665

[45] Date of Patent: Jan. 28, 1986

[54] ADJUSTABLE HANGER

[76] Inventor: Fred L. Rynearson, 111 N. State, Decatur, Tex. 76234

[21] Appl. No.: 632,692

[22] Filed: Jul. 23, 1984

Related U.S. Application Data

[63] Continuation of Ser. No. 344,368, Feb. 1, 1982.

[51] Int. Cl.[4] ..... A47G 1/24

[52] U.S. Cl. ..... 248/495; 248/493

[58] Field of Search ..... 248/492–498

[56] References Cited

U.S. PATENT DOCUMENTS

| | | | |
|---|---|---|---|
| 454,111 | 6/1891 | Coupe | 248/493 |
| 500,365 | 6/1893 | Berbecker | 248/493 |
| 2,495,477 | 1/1950 | Raitt | 248/493 |
| 2,697,572 | 12/1954 | Pfankuch | 248/495 |
| 3,226,065 | 12/1965 | Smith | 248/493 |
| 3,251,569 | 5/1966 | Rynearson | 248/493 |

FOREIGN PATENT DOCUMENTS

| | | | |
|---|---|---|---|
| 151164 | 8/1902 | Fed. Rep. of Germany | 248/495 |
| 170752 | 11/1921 | United Kingdom | 248/493 |

*Primary Examiner*—Reinaldo P. Machado
*Assistant Examiner*—Alvin Chin-Shue
*Attorney, Agent, or Firm*—Arthur F. Zobal

[57] ABSTRACT

An adjustable hanger for hanging objects such as pictures, mirrors, etc. The hanger employs a sliding member which is adjustable by a threaded bolt for tightening the picture wire and for adjusting the height of the picture relative to the hanger. A lateral slot is formed in the sliding member and two slots are formed in the body of the hanger on opposite sides of the sliding member for receiving the wire of the picture.

1 Claim, 6 Drawing Figures

Fig. 1
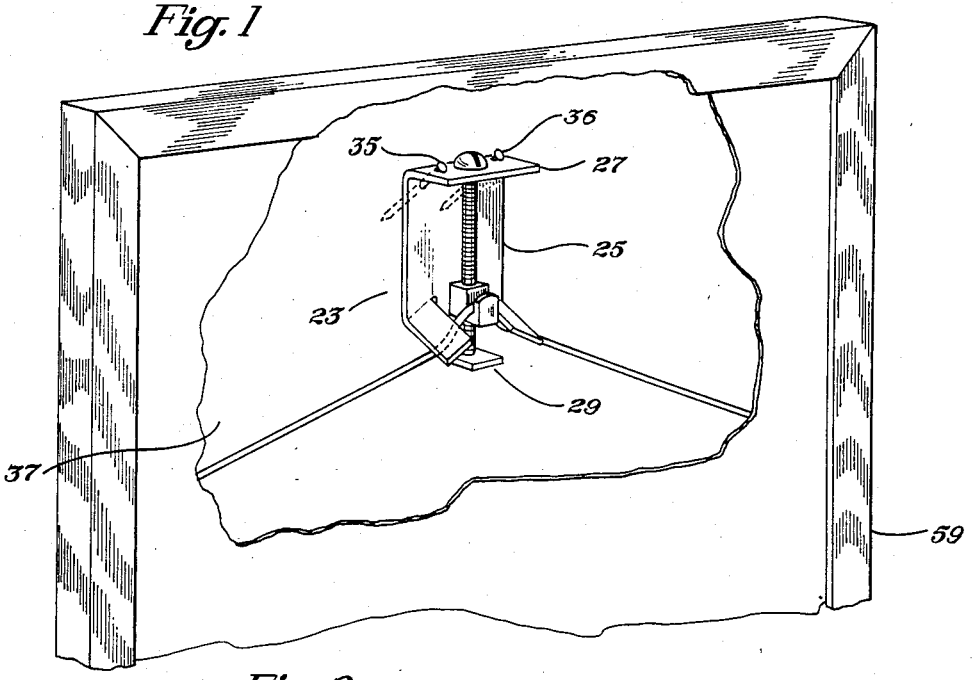
Fig. 2
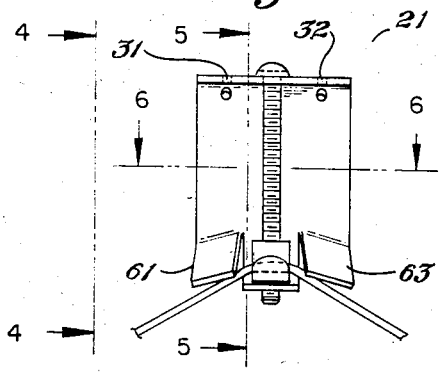
Fig. 3
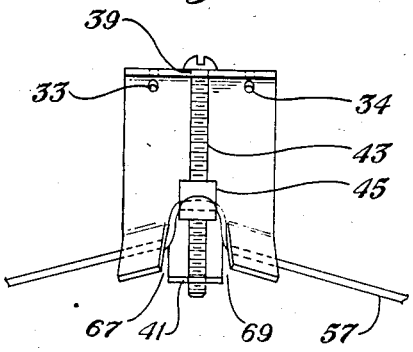
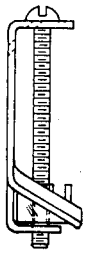
Fig. 4
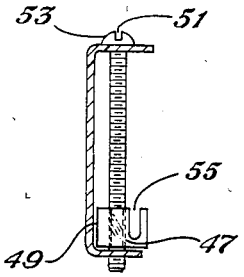
Fig. 5
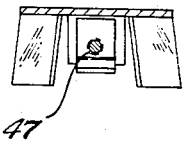
Fig. 6

ADJUSTABLE HANGER

This is a continuation of co-pending application Ser. No. 344,368, filed Feb. 1, 1982.

BACKGROUND OF THE INVENTION

1. Field of the Invention

This invention relates to a hanger for hanging objects such as pictures, mirrors or the like upon a wall.

2. Description of the Prior Art

U.S. Pat. No. 3,251,569 discloses an adjustable hanger for hanging objects such as pictures, mirrors or the like upon a wall. It employs a sliding member which is adjustable by a threaded shaft for tightening the picture wire and for adjusting the height of the picture relative to the hanger. The picture wire is attached to the hanger by threading the wire through apertures formed through the frame of the hanger and through an aperture formed through the sliding member. This has disadvantages in that it requires the wire to be attached to the picture frame after its is threaded through the hanger.

SUMMARY OF THE INVENTION

It is an object of the present invention to provide an adjustable hanger of the type having a sliding member which is adjustable by a threaded member wherein the wire of a picture or the like may be readily coupled to the sliding member and to the body of the hanger without the necessity of threading the wire through apertures.

The adjustable hanger comprises a lateral slot formed in the sliding member and two slots formed in the body of the hanger on opposite sides of the sliding member for readily receiving the wire of a picture or the like.

BRIEF DESCRIPTION OF THE DRAWINGS

FIG. 1 illustrates the adjustable hanger of the present invention with the wire of a picture frame or the like attached thereto. In FIG. 1, the adjustable hanger is shown located on the back side of the picture.

FIG. 2 is a front view of the adjustable hanger of FIG. 1 with the wire of a picture frame or the like attached thereto but in an untightened condition.

FIG. 3, is a front view of the adjustable hanger of FIG. 1 with the wire of a picture frame or the like attached thereto and in a tightened condition.

FIG. 4 is a side view of FIG. 2 as seen along the line 4—4 thereof.

FIG. 5 is a cross-sectional view of FIG. 2 taken through the line 5—5 thereof.

FIG. 6 is a cross-sectional view of FIG. 2 taken through the line 6—6 thereof.

DESCRIPTION OF THE PREFERRED EMBODIMENTS

Referring now to the drawing, the adjustable hanger of the present invention is identified by reference numeral 21. It comprises a body 23 having a rear wall 25 with spaced upper and lower walls 27 and 29 extending outward therefrom. Apertures 31, 32 and 33, 34 are formed through the upper wall 27 and through the rear wall 25 for receiving nails 35 and 36 for attaching the hanger to a vertical wall 37 of a house or building. Aligned apertures 39, 41 are formed through upper and lower walls 27 and 29 for freely receiving a threaded bolt 43. A slide member 45 has a threaded aperture 47 formed therethrough. The bolt 43 is threaded through the aperture 47. The back side 49 of the slide member 45 is adapted to engage and slide against the rear wall 25. Thus when the bolt 43 is rotated in one direction, the slide member 45 will move toward wall 27 and when it is rotated in an opposite direction it will move toward wall 29. The bolt 43 has a slot 51 formed in its head 53 for receiving the end of a screw driver for rotating the bolt. Preferably, the threads on the bolt 43 and in the slide member 45 are formed such that when the bolt 43 is rotated clockwise as seen from its head 53, the slide member 45 will move upward from lower wall 29 to upper wall 27.

The slide member 45 has a lateral slot 55 formed in its top portion outward from its threaded aperture 47 for receiving the hanging wire 57 of an object 59 such as a picture, mirror, etc. Two members 61 and 63 extend outward at an oblique angle from the rear wall 25 near the lower wall 29 forming two slots 67 and 69 with the wall 29 on opposite sides thereof for receiving the wire 57.

In use, the hanger 21 is secured to the wall 37 at the approximate position of the desired picture mounting i.e. within an inch or so of the desired height of the top of the top of the picutre. The slide member 45 is located near the bottom wall 29. The wire 57, having both ends secured to the picture frame 59 then is inserted into slots 55 and 67, 69 and the bolt 43 is rotated clockwise to move the slide member 45 upward. This draws the wire 57 through slots 67 and 69, tightening the wire and raising the picture. The members 61 and 63 extend outward beyond the wall 29 sufficient to prevent the wire 57 from slipping out of the slots 67 and 69.

As can be understood, the hanger of the present invention allows a picture or the like to be readily hung at the desired height and prevents the picture from tilting after adjustment of the position thereof. The hanger also may be employed to mount a picture at an angle by attaching the wire to the hanger at some off-center position.

The hanger 21 also may be secured to a wall with the wall 29 located upward and the wall 27 located downward. In this embodiment, the bolt 43 will be located with its head 53 next to wall 29 and the slide member 45 will be located with its slot 55 facing downward. With the wire 57 in the slots 55, 67 and 69, the picture is raised by rotating the bolt 43 to move the slide member 45 downward. In this embodiment, apertures will be formed in the hanger 21 at the end opposite wall 27 for receiving nails for securing the hanger 21 to a wall.

I claim:

1. An adjustable hanger for mounting a picture or the like to a generally vertical mounting surface, the picture or the like having a flexible support line, comprising:

a body comprising a rear wall having spaced first and second walls at first and second ends respectively extending outward from one side of said rear wall, said body being adapted to be secured to the mounting surface with said first and second walls extending outward therefrom, aligned apertures formed through said first and second walls respectively, a slide member having a threaded aperture formed therethrough, an elongated threaded member extending through said apertures formed through said first and second walls and threaded through said threaded aperture formed through said slide member such that upon rotation of said elongated threaded member, said slide member engages said body and moves between said first and second walls, said slide member comprising holding means for receiving the flexible support line of a picture or the like, said rear wall near said second end being formed into first and second members located on opposite sides of a central end portion with said second wall extending outward from said central end portion at said second end, said first and second members having outer edges and inner edges, said first and second members extending outwardly from said one side of said rear wall from first and second positions respectively between said first and second ends, said first and second members extending obliquely outwardly from said rear wall such that said first and second members define acute angles respectively relative to said central end portion of said rear wall, said inner edges of said first and second members being located closer to said first end than said outer edges respectively of said first and second members, said inner edges of said first and second members and said central portion of said rear wall near said second end forming two slots respectively for receiving the flexible support line of a picture or the like whereby when said elongated threaded member is rotated in a direction to move said sliding member toward said first wall, the flexible support line of a picture or the like when received by said holding means of said slide member and in said two slots, is moved through said two slots toward said first wall.

* * * * *